US006002376A

United States Patent [19]

Chiba

[11] Patent Number: 6,002,376

[45] Date of Patent: Dec. 14, 1999

[54] ANTENNA DRIVING APPARATUS

[75] Inventor: Masaki Chiba, Tokyo, Japan

[73] Assignee: NEC Corporation, Japan

[21] Appl. No.: 09/071,633

[22] Filed: May 1, 1998

[30] Foreign Application Priority Data

May 2, 1997 [JP] Japan ..... 9-114876

[51] Int. Cl.[6] ..... H01Q 1/12

[52] U.S. Cl. ..... 343/878; 343/765; 343/882

[58] Field of Search ..... 343/757, 765, 343/766, 704, 761, 839, 882, 878; H01Q 1/12

[56] References Cited

U.S. PATENT DOCUMENTS

| | | | |
|---|---|---|---|
| 3,665,482 | 5/1972 | Cresswell | 343/765 |
| 3,886,559 | 5/1975 | Lanson et al. | 343/726 |
| 4,238,802 | 12/1980 | Speicher | 343/765 |
| 4,392,140 | 7/1983 | Bastian et al. | 343/765 |
| 5,075,682 | 12/1991 | Dehnert | 342/352 |
| 5,245,351 | 9/1993 | Chou | 343/766 |
| 5,874,925 | 2/1999 | Choi | 343/840 |

FOREIGN PATENT DOCUMENTS

| | | | |
|---|---|---|---|
| 5746309 | 8/1980 | Japan | H01Q 3/08 |

*Primary Examiner*—Don Wong
*Assistant Examiner*—Shih-Chao Chen
*Attorney, Agent, or Firm*—Ostrolenk, Faber, Gerb & Soffen, LLP

[57] ABSTRACT

An antenna driving apparatus includes an antenna driving gear (3) which has a tooth portion (3*a*) on part of its periphery and is rotated by rotation of a driving force transmitting gear (2) which is engaged with the tooth portion (3*a*) of the antenna driving gear (3). A gear cover (12) which has a plurality of cover elements (12*a*) and is pivotally supported on the tooth portion (3*a*) of the antenna driving gear (3) at each of both ends tracks around an opposite side of the driving force transmitting gear (2) and back to the antenna driving gear to cover the tooth portion (3*a*) and the driving force transmitting gear (2). Each of the cover element (12*a*) is designed to have a substantially U-shaped cross-section to form a space to which the tooth portion (3*a*) faces. Adjacent ones of the cover elements are swingably linked to each other.

10 Claims, 7 Drawing Sheets

ANTENNA DRIVING APPARATUS

BACKGROUND OF THE INVENTION

1. Field of the Invention

The present invention relates to an antenna driving apparatus having a gear cover to protect gears for driving an antenna such as a parabola antenna.

2. Description of the Related Art

An antenna driving apparatus having a gear cover which covers a gear tooth portion of an antenna driving gear in order to protect the antenna driving gear from dust, rain water, etc. has been generally known as one type of antenna driving apparatus for a parabola antenna, etc. which is mounted on the ground.

This type of antenna driving apparatus is disclosed in Japanese Utility Model Application Laid-open Publication No. Sho-57-46309 entitled "ANTENNA APPARATUS HAVING GEAR PROTECTION COVER", and this apparatus is constructed as shown in FIGS. 1 to 3.

The antenna driving apparatus as disclosed in the above publication will be described with reference to FIGS. 1 to 3. In the figures, reference numeral 1 represents an antenna driving apparatus which includes a driving force transmitting gear 2, an antenna driving gear 3 and a gear cover 4.

The driving force transmitting gear 2 is rotated by a driving source 5 such as a motor, and it is mounted on an antenna support table 6. The antenna driving gear 3 is provided with a tooth portion 3*a* which is formed on the periphery thereof and pivotally rotated around a center shaft (elevation axis) 7 by the driving force transmitting gear 2. The tooth portion 3*a* is provided substantially 90 degrees around the center shaft 7 in the peripheral direction thereof. The antenna driving gear 3 is mounted on the antenna support table 6. A parabola antenna (antenna main reflection mirror) 8 is rotated by the above units. Further, a guide rail 9 is mounted on each side surface of the antenna driving gear 3 so as to extend along the peripheral or circumferential direction.

The gear cover 4 comprises a plurality of gear cover elements 4*a* (4*a*1, 4*a*2, . . . , 4*a*n), and gear cover elements 4*a*1, 4*a*1 at both end portions relative to the peripheral direction are fixed to the side surface of the antenna driving gear 3 and the antenna support table 6, respectively. Each gear cover element 4*a* (4*a*1, 4*a*2, . . . , 4*a*n) which covers the gear tooth portion 3*a* of the antenna driving gear 3 is mounted on the guide rail 9 through a shoe 10 so that the gear cover 4 is freely expanded and contracted in the peripheral direction.

Each cover element 4*a*1, 4*a*2, . . . , 4*a*n of the gear cover 4 is made of metal and has a box shape, and the tooth portion 3*a* of the antenna driving gear 3 faces the inside of each cover element. Each cover element 4*a*1, 4*a*2, . . . is formed with an inner space therein so that a cover element at an antenna driving gear side of the adjacent cover elements can accommodate an antenna support table side of a cover element therein. Accordingly, the cover elements 4*a*1, 4*a*2, . . . , 4*a*n are designed so that the cover element 4*a*n at the terminal end has the largest inner space and the cover element 4*a*1 at the starting end has the smallest inner space, whereby the gear cover 4 can be expanded and contracted by changing a relationship in the circumferential position between the neighboring cover elements in accordance with the rotation of the antenna driving gear 3. FIG. 1 shows an expanded state of the gear cover 4, while FIGS. 2 and 3 show a contracted state of the gear cover 4.

In the above conventional antenna driving apparatus, the cover element at the antenna driving gear side of the adjacent cover elements 4*a*1, 4*a*2, . . . , 4*a*n is designed in such a shape that it can accommodate the cover element at the antenna support table side of the adjacent cover elements, and thus the respective cover elements 4*a*1, 4*a*2, . . . , 4*a*n must be designed to be different sizes. As a result, the respective cover elements 4*a*1, 4*a*2, . . . , 4*a*n are designed to be different shapes or sizes, and this makes it cumbersome to manufacture the gear cover 4.

Further, since the respective cover elements 4*a*1, 4*a*2, . . . , 4*a*n are designed so that the rear cover element (antenna driving gear side cover element) can accommodate the adjacent front cover element (antenna support table side of the cover element) therein, the cover elements are gradually larger in the order from the cover element 4*a*1 at the start end to the cover element 4*a*n at the terminal end, and thus the overall gear cover size is increased.

Still further, since each cover element 4*a*1, 4*a*2, . . . , 4*a*n is formed into a box shape, it is necessary to detach the gear cover 4 from the antenna driving gear 3 for cleaning and inspection, and this makes the cleaning and inspection of the gear cover 4 cumbersome.

SUMMARY OF THE INVENTION

The present invention has been implemented in view of the foregoing situation, and has an object to provide an antenna driving apparatus which can simplify the manufacturing process of the gear cover and also the cleaning and inspection of the gear cover, and further can be designed in a small size.

In order to attain the above object, according to the present invention, there is provided an antenna driving apparatus, comprising an antenna driving gear which has a first tooth portion on a part of a periphery thereof; a driving force transmitting gear which has a second tooth portion on a periphery thereof engaged with the first tooth portion; and a gear cover having a plurality of cover elements which is pivotally supported on the first tooth portion of the antenna driving gear at each neighborhood of both ends in a peripheral direction thereof and disposed through an opposite side of the driving force transmitting gear to the antenna driving gear side to cover the first and second tooth portions, wherein each of the cover elements is designed to have substantially U-shaped cross section to form a space portion to which the first and second tooth portions are faced, and respective two adjacent cover elements are swingably linked to each other.

According to an aspect of the present invention, the antenna driving apparatus further comprises a guide roller for guiding the gear cover so as to bypass through the opposite side of the driving force transmitting gear to the antenna driving gear side.

According to an aspect of the present invention, the antenna driving apparatus further comprises a tensioner for applying tension to the gear cover to prevent slacking thereof.

According to an aspect of the present invention, the respective two adjacent cover elements are linked to each other by a joint pin.

According to an aspect of the present invention, the respective two adjacent cover elements are linked to each other by a flexible joint member. Here, a gap between the respective two adjacent cover elements formed at both side walls thereof and at a bottom portion thereof can be sealed with the flexible joint member.

According to an aspect of the present invention, the antenna driving apparatus further comprises a cover piece secured to a side surface of the antenna driving gear, the cover piece covering a gap between an edge of a side wall of the cover element and the side surface of the antenna driving gear.

According to the present invention, each of the cover elements of the gear cover is designed to have a substantially U-shaped cross section to form a space portion to which the tooth portion is faced, and the respective two adjacent cover elements of these cover elements are freely swingably linked to each other, so that all the cover elements can be designed with the same dimensions. Therefore, a gear cover having the cover elements having same shape can be achieved, so that the manufacturing process of the gear cover can be simplified.

Further, all the cover elements can be designed to have the same shape, and this makes it possible to reduce the dimension of each cover element, so that the overall size of the cover can be reduced.

Still further, the gear cover has cover elements each of which is designed to have a substantially U-shaped cross section, and disposed at the opposite side of the driving force transmitting gear to the antenna driving gear side. Therefore, it is unnecessary to detach the gear cover from the antenna driving gear for cleaning or inspection, so that the cleaning and inspection of the gear cover can be simplified.

DETAILED DESCRIPTION OF THE PREFERRED EMBODIMENTS

Preferred embodiments according to the present invention will be described hereunder with reference to the accompanying drawings.

Figure 1:
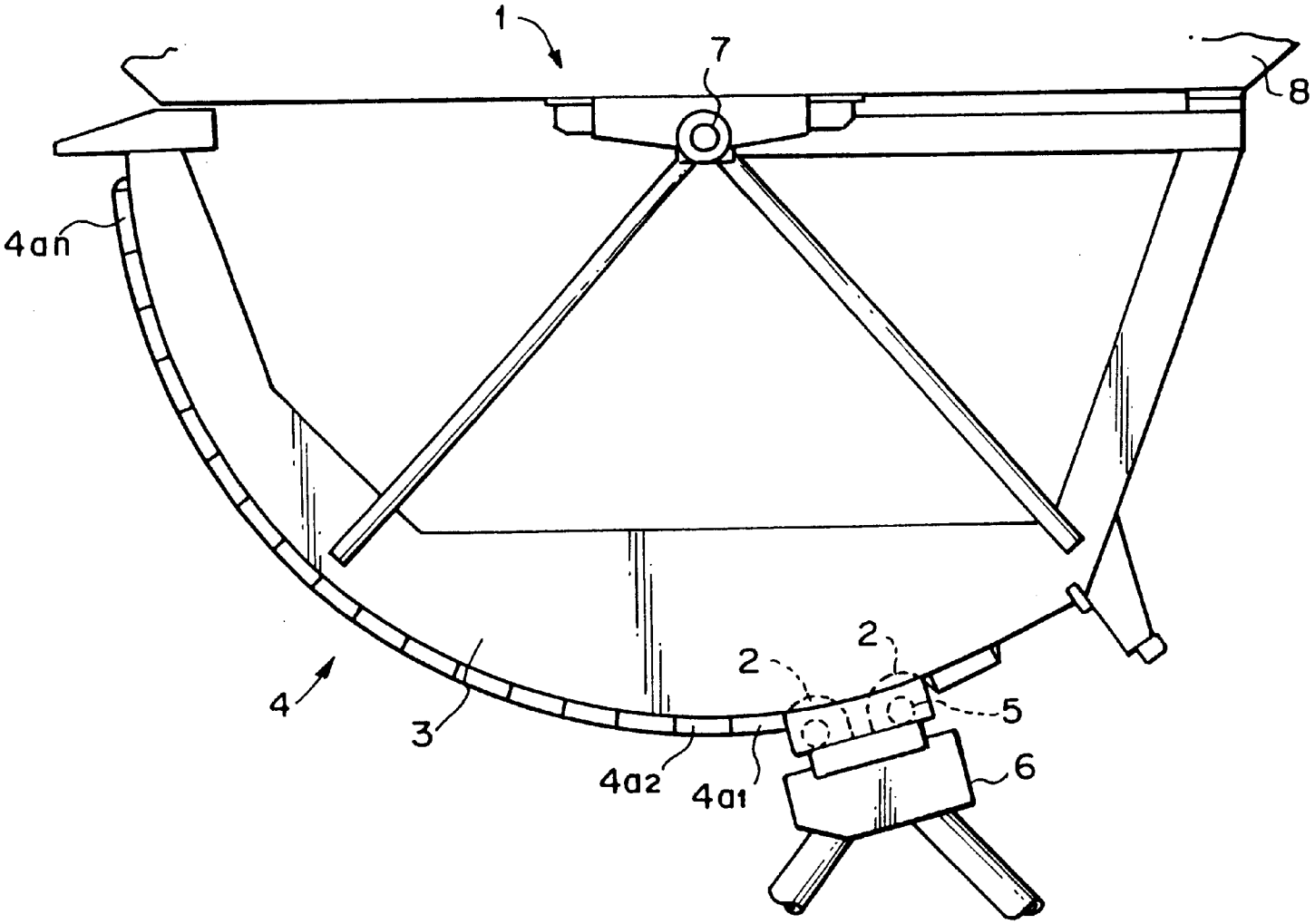
FIG.1 PRIOR ART
FIG. 1 is a front view of a part of a conventional antenna driving apparatus.
Figure 2:
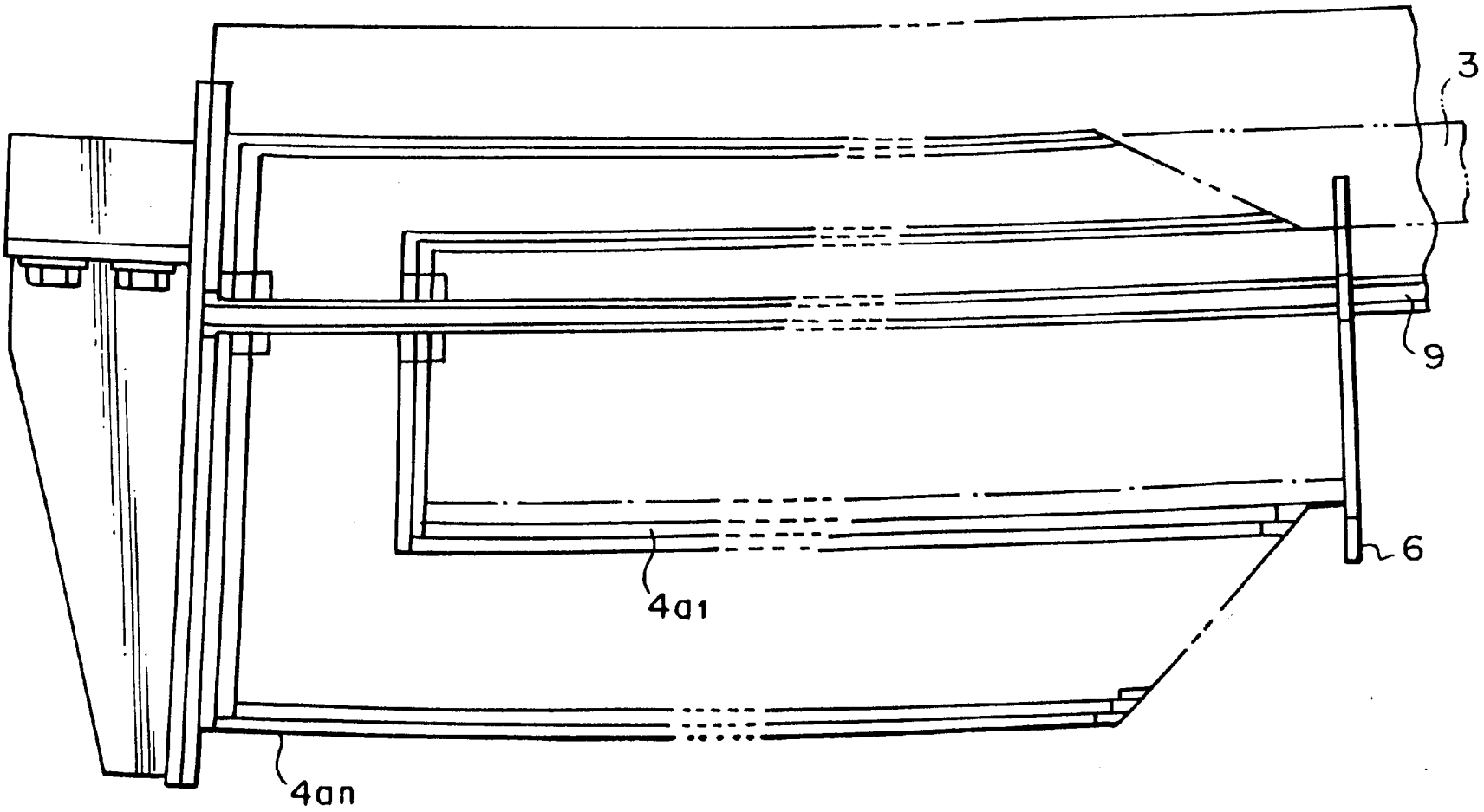
FIG.2 PRIOR ART
FIG. 2 is a cross-sectional view of a gear cover shown in FIG. 1.
Figure 3:
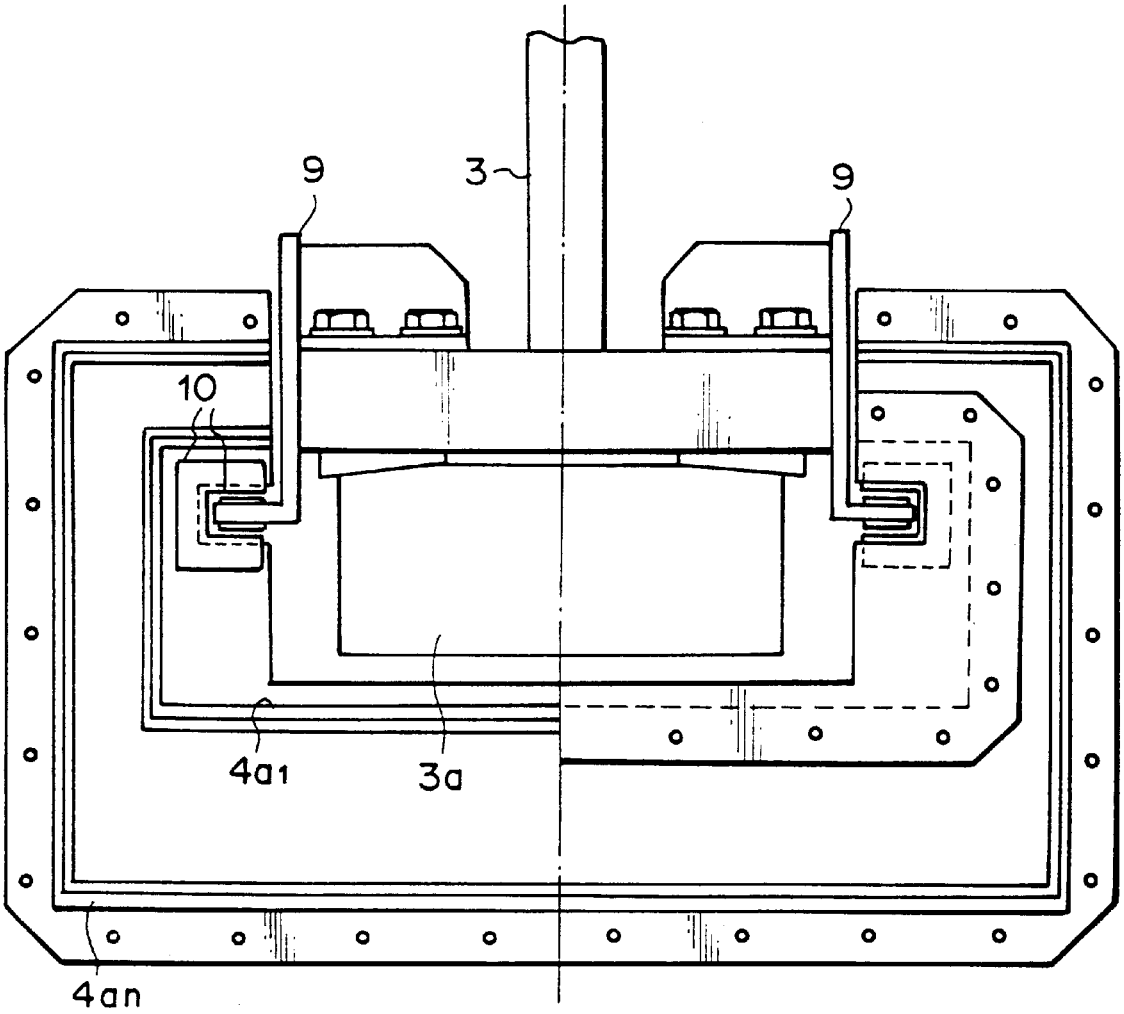
FIG.3 PRIOR ART
FIG. 3 is a longitudinally sectional view showing the gear cover shown in FIG. 1.
Figure 4:
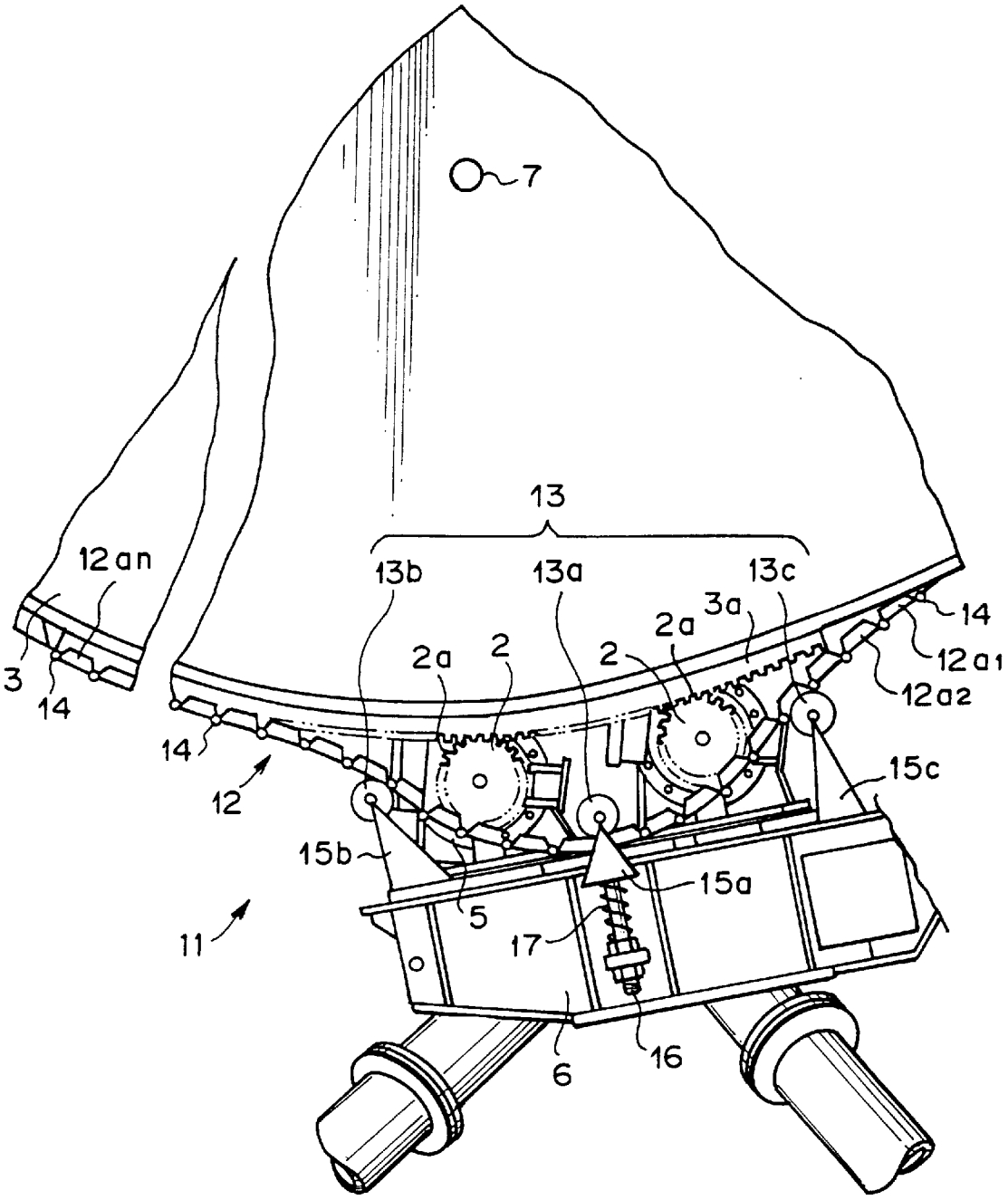
FIG. 4 is a front view showing the main part of an antenna driving apparatus according to a first embodiment of the present invention.
Figure 5:
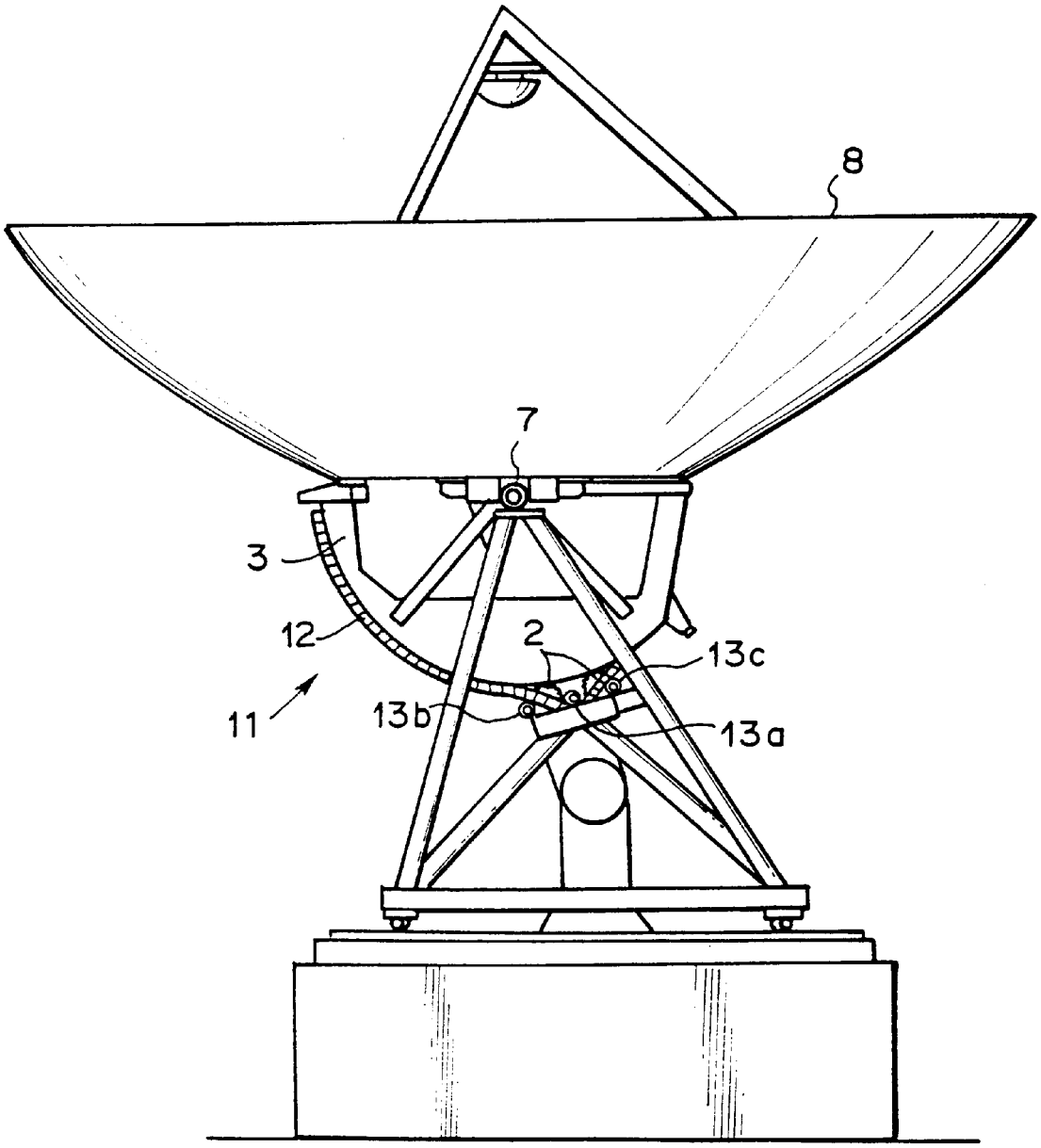
FIG. 5 is a front view showing the overall construction of the antenna driving apparatus according to the present invention.
Figure 6A:
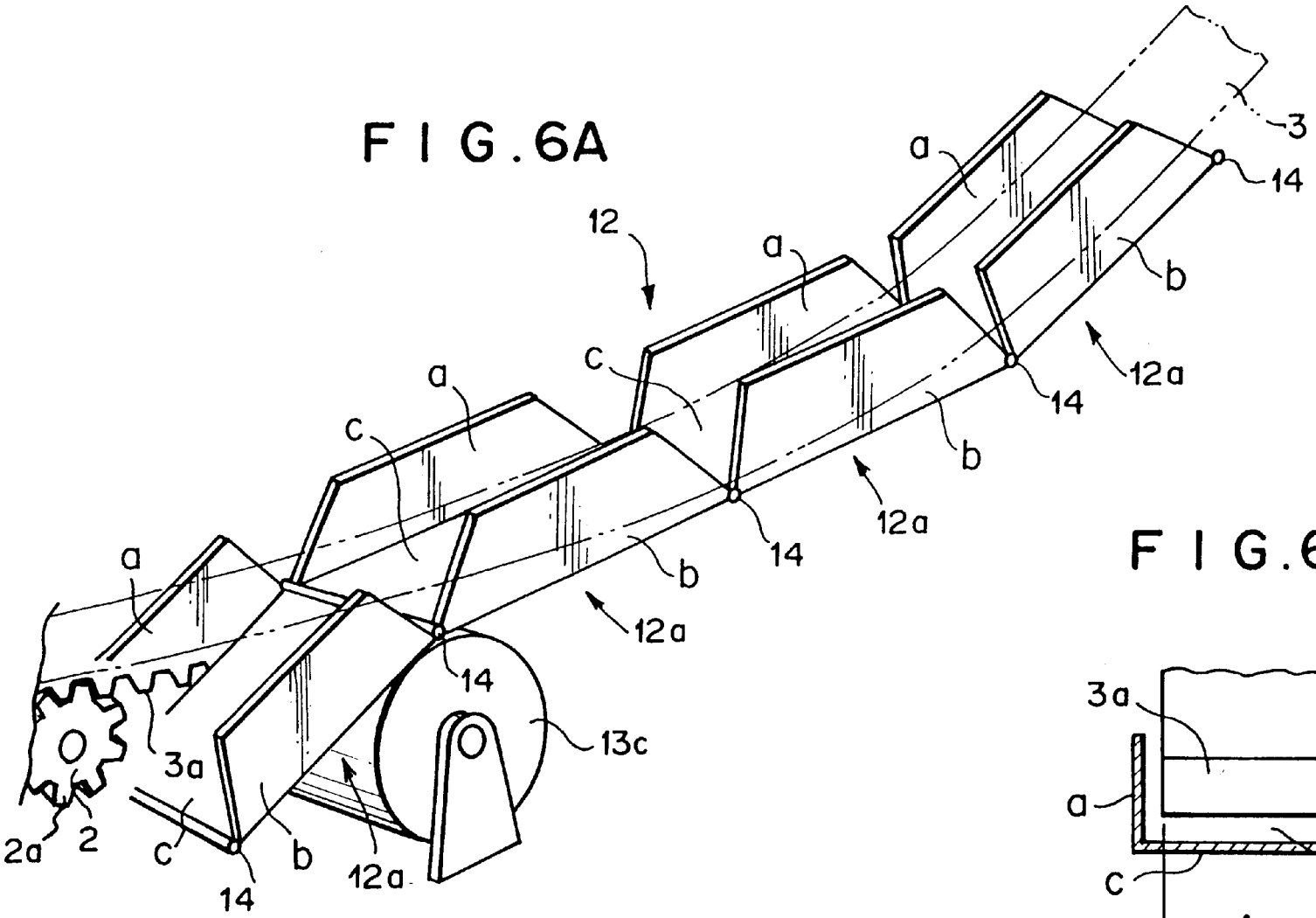
FIGS. 6A and 6B are a perspective view and a cross-sectional view showing a gear cover of the antenna driving apparatus according to the first embodiment of the present invention.
Figure 6B:
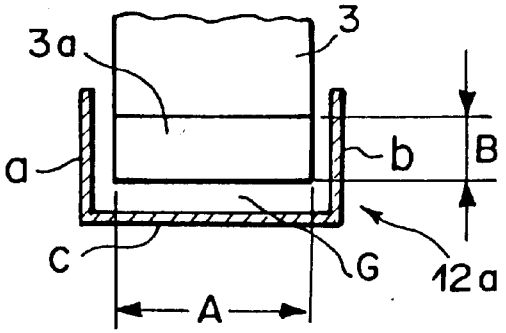

FIG. 4 is a front view showing the main part of an antenna driving apparatus according to a first embodiment of the present invention, FIG. 5 is a front view showing the whole construction of the antenna driving apparatus of the first embodiment of the present invention, and FIGS. 6A and 6B are a perspective view and a cross-sectional view showing a gear cover of the antenna driving apparatus according to the first embodiment of the present invention. In the figures, the same elements as a FIGS. 1 to 3 are represented by the same reference numerals, and detailed description thereof is therefore omitted.

In the figures, reference numeral 11 represents the antenna driving apparatus, which has a driving force transmitting gear 2 and an antenna driving gear 3. The driving force transmitting gear 2 is rotated by a driving source 5 such as a motor, and it is mounted on an antenna support table 6. The antenna driving gear 3 is provided with a tooth portion 3*a* which is formed on the periphery thereof and pivotally rotated around a center shaft (elevation axis) 7 by the driving force transmitting gear 2. The tooth portion 3*a* is provided along substantially 90 degrees around the center shaft 7 in the peripheral direction thereof. The antenna driving gear 3 is mounted on the antenna support table 6. A parabola antenna 8 is rotated by the above units.

The antenna driving apparatus has a gear cover 12 and a guide roller 13 comprising rollers 13*a*, 13*b*, 13*c*. Both ends of the gear cover 12 are pivotally and freely swingably attached through a pin 14 to the tooth portion 3*a* of the antenna driving gear 3 in the neighborhood of both ends thereof in the peripheral direction, and it is disposed so as to pass around the opposite side of the driving force transmitting gear 2 to the antenna driving gear 3. This gear cover 12 comprises a plurality of cover elements 12*a* (12*a*1, 12*a*2, . . . , 12*a*n) which cover the tooth portion 2*a* of the driving force transmitting gear 2 and the tooth portion 3*a* of the antenna driving gear 3.

As shown in FIGS. 6A and 6B, each cover element 12*a* (12*a*1, 12*a*2, . . . , 12*a*n) is designed so as to have a U-shaped or channel-shaped cross section having two side walls a, b facing to each other through a space portion G to which the tooth portions 2*a*, 3*a* of the gears 2, 3 are confronted, and a bottom portion c for linking the side walls a, b. The height of the side walls a, b of each cover element 12*a*1, 12*a*2, . . . , 12*a*n is set to be slightly larger than the tooth depth B of the antenna driving gear 3, and the dimension between the side walls of each cover element is set to be slightly larger than the face width A of the antenna driving gear 3 as shown in FIG. 6B.

The respective two cover elements which are adjacent to each other are freely swingably linked to each other through a pin 14. The cover elements 12*a*1 and 12*a*n at both ends of the gear cover 12 are pivotally mounted on the side surfaces of the antenna driving gear 3. Accordingly, the gear cover 12 is moved interlockingly with the rotation of the antenna driving gear 3. Attached in this manner, the gear cover 12 is wrapped around the antenna driving gear 3 while bypassing (turning) around the guide roller 13. That is, the gear cover 12 is moved while tracing the locus corresponding to the curvature around the guide roller 13 and the curvature around the antenna driving gear 3.

The guide roller 13 comprises a single guide roller 13*a* for pressing the bottom portions c of the cover elements 12*a*1, 12*a*2, . . . , 12*a*n so as to move the gear cover 12 away from the surface of the antenna driving gear 3, and guide rollers 13*b* and 13*c* which are juxtaposed at each side of the guide roller 13*a* for supporting the bottom portions c of the cover elements 12*a*1, 12*a*2, . . . , 12*a*n. The guide rollers 13*a*, 13*b* and 13*c* are freely rotatably mounted on the antenna support table 6 through roller support members 15*a*, 15*b* and 15*c*, respectively. Accordingly, the gear cover 12 is bypassed around the opposite side of the driving force transmission gear 2 to the antenna driving gear 3 through neighborhood of the guide roller 13 (moves away from the contracting surfaces between the driving force transmission gear 2 and the antenna driving gear 3) and guided to prevent the gear cover 12 from getting jammed between the gears 2 and 3.

Further, a tensioner 17 having an adjustment spring 16 for applying force to the guide roller 13*a* is provided to urge the guide roller 13*a* away from the antenna driving gear 3, thereby preventing slacking of the gear cover 12. The tensioner may also be provided to urge the guide rollers 13*b*, 13*c* toward the antenna driving gear 3.

The tooth portion 3*a* of the antenna driving gear 3 which is exposed to the outside in the neighborhood of the guide roller 13 is covered by a cover (not shown).

According to the antenna driving apparatus thus constructed, when the driving force transmitting gear 2 is rotated by the driving source 5, the antenna driving gear 3 is rotated in a rotational direction corresponding to that of the driving force transmitting gear 2, and the parabola antenna 8 is also rotated. The gear cover 12 moves interlockingly with the rotation of the antenna driving gear 3 while being guided by the guide rollers 13*a* to 13*c*.

Figure 7A:
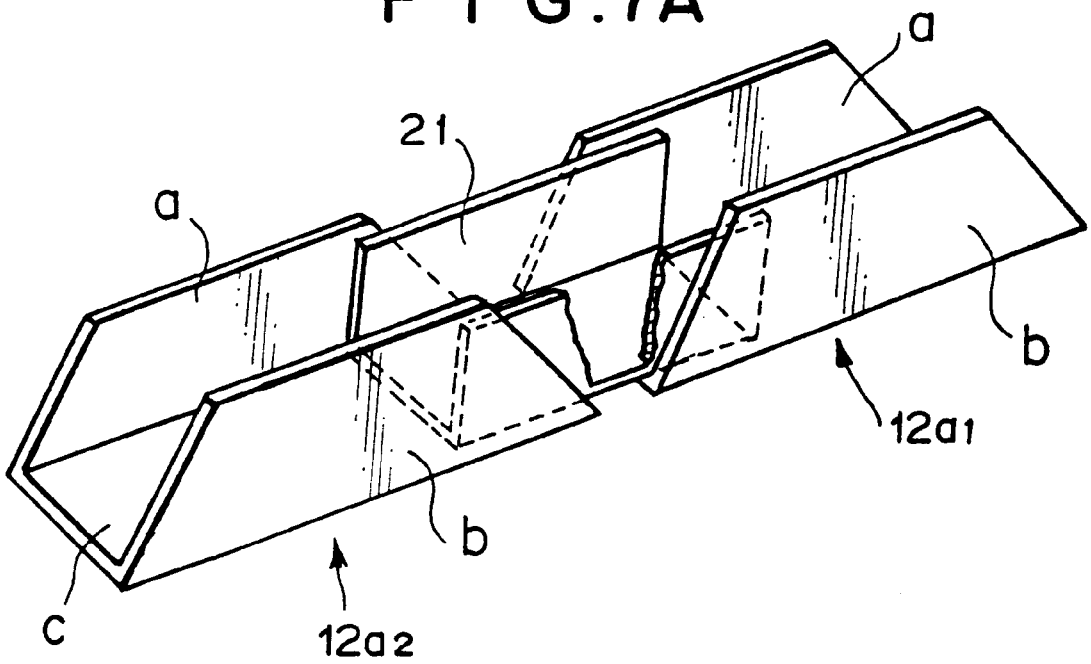
FIGS. 7A and 7B are a perspective view and a cross-sectional view showing the main part of a gear cover of an antenna driving apparatus according to a second embodiment and a third embodiment of the present invention, respectively.

In the above embodiment, the respective two adjacent cover elements (the cover elements 12*a*1 and 12*a*2, for example) of the cover elements 12*a*1, 12*a*2, . . . , 12*a*n are freely swingably linked to each other by a link pin 14. However, the present invention is not limited to this embodiment. For example, the same effect as the first embodiment can be obtained if the respective cover elements are linked to each other by a flexible joint member 21 in place of the link pin 14 as shown in FIG. 7A (a second embodiment). The flexible joint member 21 is made of plastics, rubbers, etc. In this case, the respective adjacent two cover elements 12*a*1, 12*a*2 are linked to each other by the flexible joint member 21 so that the gap between the elements formed at the both side walls a, b and at the bottom portion c is sealed with the flexible joint member 21, so that the dust-proof and water-proof effects can be further enhanced.

Figure 7B:
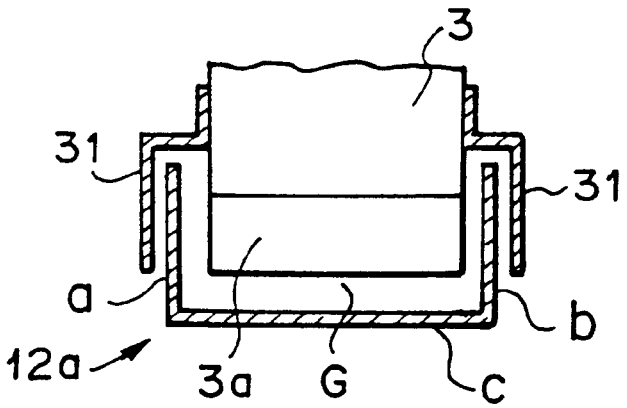

Further, in the above first embodiment, each of the cover elements 12*a*1, 12*a*2, . . . , 12*a*n covers the tooth portion 3*a* of the antenna driving gear 3 with a gap opened upwardly between the upper edges of the side walls a, b of the cover elements and the side surfaces of the antenna driving gear 3, however, the present invention is not limited to the above embodiment. If a cover piece 31 is secured to the side surface of the antenna driving gear 3 so as to cover the above-mentioned gap as shown in FIG. 7B (a third embodiment), the dust-proof and water-proof effects can be more greatly enhanced than the first embodiment.

In the above embodiments, the present invention is applied to the case where the parabola antenna is driven, however, the embodiments as described above may be applied to the driving of the other antennas in the same manner.

What is claimed is:

1. An antenna driving apparatus, comprising:

an antenna driving gear which has a tooth portion on a part of a periphery thereof;

a driving force transmitting gear which has a tooth portion on a periphery thereof engaged with the tooth portion of the antenna driving gear; and a gear cover having a plurality of cover elements and further having opposite ends which are pivotally supported on the tooth portion of the antenna driving gear, wherein the driving force transmitting gear is positioned between the gear cover and the antenna driving gear and between the ends of the gear cover such that the gear cover covers the tooth portions of both the antenna driving gear and the driving force transmitting gear, each of the cover elements has a substantially U-shaped cross-section to form a space in which the tooth portions are accommodated, and adjacent cover elements are swingably linked to each other.

2. The antenna driving apparatus as claimed in claim 1, further comprising at least one guide roller for guiding the gear cover away from the antenna driving gear, around a side of the driving force transmitting gear opposite a side engaging with the antenna driving gear, and back to the antenna driving gear.

3. The antenna driving apparatus as claimed in claim 1, further comprising a tensioner for applying tension to the gear cover to prevent slacking thereof.

4. The antenna driving apparatus as claimed in claim 1, wherein adjacent cover elements are linked to each other by a joint pin.

5. The antenna driving apparatus as claimed in claim 1, wherein adjacent cover elements are linked to each other by a flexible joint member.

6. The antenna driving apparatus as claimed in claim 5, wherein a gap between adjacent cover elements formed by side walls thereof and bottom portions thereof is sealed with the flexible joint member.

7. The antenna driving apparatus as claimed in claim 1, further comprising a cover piece secured to a side surface of the antenna driving gear, the cover piece covering a gap between an edge of a side wall of the cover element and the side surface of the antenna driving gear.

8. An antenna driving apparatus, comprising:

an antenna driving gear;

a driving force transmitting gear engaged with the antenna driving gear; and a gear cover having a plurality of cover elements and further having opposite ends pivotally supported on the periphery of the antenna driving gear, wherein the driving force transmitting gear is positioned between the ends of the gear cover and between the gear cover and the antenna driving gear such that the gear cover follows the periphery of the antenna driving gear until a vicinity of the driving force transmitting gear, upon which the gear cover diverges away from the antenna driving gear to follow the periphery of the driving force transmitting gear around and back to the antenna driving gear so as to cover teeth portions of both the antenna driving gear and the driving force transmitting gear.

9. The antenna driving apparatus as claimed in claim 8, wherein each of the plurality of gear cover elements are the same size.

10. The antenna driving apparatus as claimed in claim 8, wherein the plurality of cover elements are pivotally linked to each other.

* * * * *